United States Patent [19]

Walling

[11] Patent Number: 4,515,532

[45] **Date of Patent: * May 7, 1985**

[54] SINGLE ACTION PNEUMATIC POWERED SPRING RETRACTABLE PUMP

[76] Inventor: John B. Walling, P.O. Box 16266, Fort Worth, Tex. 76133

[ * ] Notice: The portion of the term of this patent subsequent to May 1, 2001 has been disclaimed.

[21] Appl. No.: 560,315

[22] Filed: Dec. 12, 1983

Related U.S. Application Data

[62] Division of Ser. No. 344,359, Feb. 1, 1982, Pat. No. 4,445,819.

[51] Int. Cl.[3] ..... F04B 41/08

[52] U.S. Cl. ..... 417/318; 417/392; 166/105.3

[58] Field of Search ..... 166/105.1, 105.3, 105.4; 417/392, 318, 401; 91/272

[56] References Cited

U.S. PATENT DOCUMENTS

| | | | |
|---|---|---|---|
| 52,204 | 1/1866 | Richardson et al. | 166/105.1 |
| 424,045 | 3/1890 | Beatty | 91/272 |
| 857,457 | 6/1907 | Goodwin | 91/272 |
| 1,445,497 | 2/1923 | Dixon | 417/392 |
| 2,379,841 | 7/1945 | Thomas | 417/318 X |
| 3,154,018 | 10/1964 | Willits | 417/403 |
| 4,445,819 | 5/1984 | Walling | 417/318 |

FOREIGN PATENT DOCUMENTS

| | | | |
|---|---|---|---|
| 585293 | 10/1959 | Canada | 417/392 |
| 221382 | 8/1942 | Switzerland | 417/392 |
| 171146 | 11/1921 | United Kingdom | 91/272 |
| 747456 | 4/1956 | United Kingdom | 417/392 |

*Primary Examiner*—Leonard E. Smith

*Attorney, Agent, or Firm*—Glaser, Griggs & Schwartz

[57] ABSTRACT

A downhole reciprocating piston pump is driven pneumatically from a surface facility for producing formation fluid from a well bore. The pump is cycled automatically without the use of electrical controls or components. A piston is received within a pump chamber thereby defining a power chamber and a production chamber, with the piston being movable between a retracted position and an extended position. High pressure air accumulated in a power fluid reservoir is admitted into the power chamber through a delivery port to extend the piston in a production stroke, and is vented from the power chamber through a relief conduit retraction of the piston. The delivery port is opened and closed and the vent port is closed and opened by first and second shuttle valves which are actuated by the piston as it nears the limit of its stroke in extension and retraction, respectively, thereby pressurizing and relieving the power chamber automatically.

4 Claims, 12 Drawing Figures

SINGLE ACTION PNEUMATIC POWERED SPRING RETRACTABLE PUMP

CROSS-REFERENCE TO RELATED APPLICATION

This application is a division of U.S. patent application Ser. No. 344,359, filed: Feb. 1, 1982 now U.S. Pat. No. 4,445,819.

BACKGROUND OF THE INVENTION

1. Field of the Invention

This invention relates generally to well production equipment, and in particular to a pneumatic submersible pump.

2. Description of the Prior Art

Various types of artificial lifts are used to bring liquids to the surface of the earth when the pressure of the liquid-bearing reservoir is insufficient to produce the formation fluids by natural means. The pumping motion of the artifical lift may originate at the surface of the ground, or below, as a result of the application of electrical or fluid power to a subsurface pump. In the usual surface powered rig, a vertically reciprocating pump element at the bottom of the well is actuated by a walking beam pivotally mounted on a Sampson post and connected at one end to a sucker rod string and at the other end to a prime mover which supplies power through a Pitman gear for producing the reciprocating motion of the sucker rod string.

Generally, in the surface powered rig, the prime mover consists of an internal combustion engine or electric motor. The cost of this prime mover, as well as its operation and maintenance, is, in many instances, a significant economic factor in the production of liquids from subterranean liquid-bearing reservoirs. The sucker rods are characterized by a short, fast stroke, resulting in low pump efficiency, high power consumption and low recovery rates. The short, fast stroke results in a churning action which causes the formation of emulsion.

An additional limitation of surface-powered rigs which operate a sucker rod through rigid production tubing is that, for practical purposes, the weight of the sucker rod for wells having a producing formation at about 10,000 feet or deeper is excessive, resulting in stretching and early failure of the rods. Moreover, the sucker rod assembly is subject to severe wear in slant-hole or crooked-hole wells. In slant-hole wells, of the type typically drilled offshore, the sucker rod is subjected to severe frictional wear because of the slant of the hole, and is therefore subject to early failure and requires frequent replacement. Frictional wear is also a serious problem in crooked holes in which the well bore follows a helical path. Because of the difficulty of drilling a vertical well at other than shallow depth, effective use of the sucker rod pumping assembly is substantially limited to shallow wells.

The cost of the prime mover, as well as its operation and maintenance, is in many instances a significant economic factor in well production operations which utilize sucker rods. Moreover, the sucker rod pump is characterized by short, fast stroke action which is not compatible with the slow supply rate of weak natural formations. It will be appreciated that the substantial capital expenditure associated with the launching, recovering, repair and operation of sucker rod units makes its use prohibitive in low production wells, and accounts for a substantial percentage of the overall production costs for other wells.

For the foregoing reasons, there has been considerable interest in improving pumping systems in which the motive force is provided by fluid power applied to a subsurface pump, thereby eliminating the sucker rod and affording precise control of the pumping action.

OBJECTS OF THE INVENTION

It is, therefore, the principal object of the present invention to provide a reciprocating piston pump which is driven pneumatically from a surface facility in which the piston extends and retracts automatically without the assistance of electrical or hydraulic components.

A related object of the present invention is to provide a pneumatic pump having a minimum number of moving parts for greater reliability and relatively low cost.

Another object of the invention is to provide a pneumatic pump in which the pump stroke rate in extension and retraction is continuously adjustable to match the pump production rate with the natural formation supply rate.

Yet another object of the invention is to provide a reciprocating piston pump which is capable of efficient operation at a relatively slow stroke rate.

Still another object of the invention is to provide an inexpensive pneumatic pump for use in shallow wells or low production wells where the cost of conventional pumps, such as sucker rod rigs, would be prohibitive.

Another object of the invention is to provide a reciprocating piston pump having an improved sand trap.

SUMMARY OF THE INVENTION

The foregoing objects are achieved in a single action piston pump in which a production piston is extended in a production stroke by high pressure air, and is retracted by a tension spring. Pneumatic power is accumulated in a power fluid reservoir within the pump housing and is resupplied with high pressure air from a surface facility to maintain high operating pressure. A production piston is received within a pump chamber thereby defining a power chamber and a production chamber, with the piston being axially movable between a retracted position and an extended position. A spring coupled to the piston applies a yieldable bias force against the piston, thereby urging it for movement toward its retracted position.

High pressure air accumulated in the power fluid reservoir is admitted into the power chamber through a delivery port to extend the piston in a production stroke, and is vented from the power chamber through a relief conduit, thereby allowing the spring to retract the piston. The delivery port is opened and closed and the vent port is closed and opened by first and second shuttle valves which are actuated by the piston as it nears the limit of its stroke in extension and retraction, respectively, thereby pressurizing and relieving the power chamber automatically.

The rate of extension of the piston during a production stroke is proportional to the pressure level of the air in the power fluid reservoir and to the effective orifice area of the delivery port. For a delivery port of a given crosssectional area, the extension rate is directly proportional to the pressure of the air in the power fluid reservoir. The retraction rate is likewise limited by the orifice area of the vent port. The high pressure air in the power chamber serves as a cushion which limits the retraction rate of the piston. The air discharged from the power chamber during retraction of the piston is conducted to the surface where it is vented to the atmosphere. The retraction rate is continuously adjustable by choking the vent conduit at the surface.

In a preferred embodiment, the production chamber is enlarged on one end by a funnel-shaped bore and cylindrical bore which, in combination, define a sand trap. A lateral bore communicates with the sand trap and intersects the pump housing, thereby providing a discharge path for sand. The sand discharge bore is opened and closed by a slotted shuttle rod which forms a part of the shuttle valve. The discharge bore remains closed during retraction of the piston and during extension of the piston until the piston nears the limit of its stroke in extension. At that point, the piston engages a stop member carried by the shuttle rod, and moves the shuttle rod until the slot is aligned with the discharge rod. A small cylindrical piston carried by the production piston forces sand and residual formation fluid out of the discharge bore as the production piston completes its downward stroke.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION OF THE PREFERRED EMBODIMENT

Figure 1A:
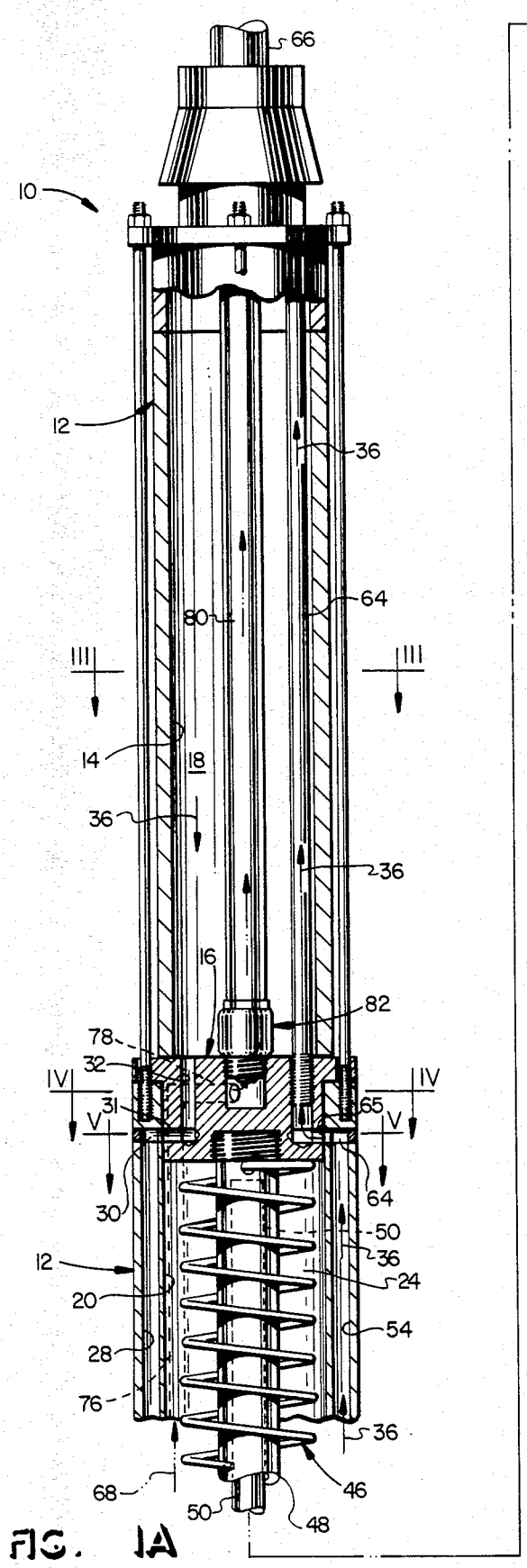
FIG. 1A is an elevation view, partly in section, of an upper portion of a pneumatic pump.

In the description which follows, like parts are marked throughout the specification and drawings with the same reference numerals, respectively. The drawings are not necessarily to scale and in some instances portions have been exaggerated in order to more clearly depict certain features of the invention.

Figure 1B:
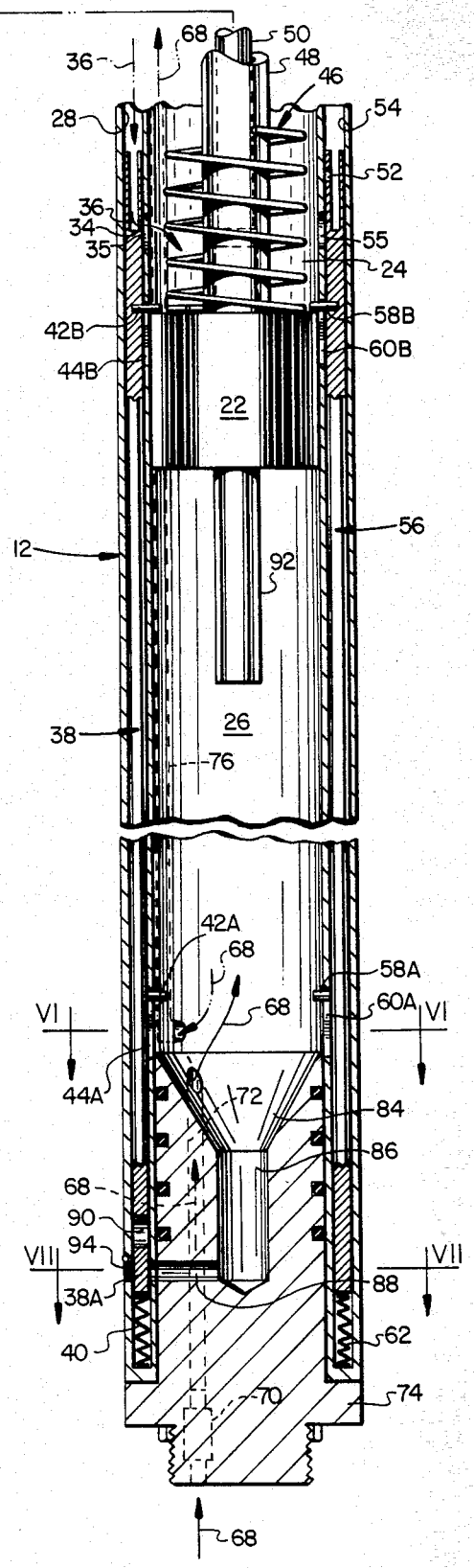
FIG. 1B is a downward continuation of FIG. 1A.

Referring now to FIGS. 1A and 1B, a single action pneumatic powered spring retractable pump is indicated generally by the reference numeral 10. The pump 10 includes an elongated pump housing 12 having a cylindrical bore 14 in which the component parts of the pump are received. The upper end of the pump housing 12 is sealed by a partition block 16. Immediately above the partition block 16 is a cylindrical chamber 18 which defines a power fluid reservoir. Immediately below the partition block 16 is a pump chamber 20 in which a cylindrical power piston 22 is received in slidable, sealing engagement. The piston 22 divides the pump chamber into an upper power chamber 24 and a lower production chamber 26.

The sidewall portion of the pump housing 12 which encloses the pump chamber 20 is provided with an axially extending charge bore 28 which defines a power fluid charge conduit. The charge bore 28 has an inlet port 30 communicating with the power fluid reservoir 18 through a lateral bore 31 and a vertical bore 32 which intersects the partition block 16. An orifice opening 34 defining a delivery port provides communication between the charge bore 28 and the power chamber 24. The orifice opening 34 communicates with the power chamber 24 through a sidewall slot 35.

High pressure air, indicated by the arrow 36, accumulated in the power fluid reservoir 18 is admitted into the power chamber 24 through the delivery port 34 and slot 35 to extend the power piston 22 in a production stroke. The delivery port is opened and closed by a shuttle rod 38 which is reciprocally received within the charge bore 28. The shuttle rod 38 is received in slidable, sealing engagement with the charge bore 28 and is reciprocally movable thrugh the charge bore between a first position (FIG. 1B) opening the delivery port 34 for pressurizing the power chamber 24 and a second position (FIG. 2) blocking the delivery port.

Figure 2:
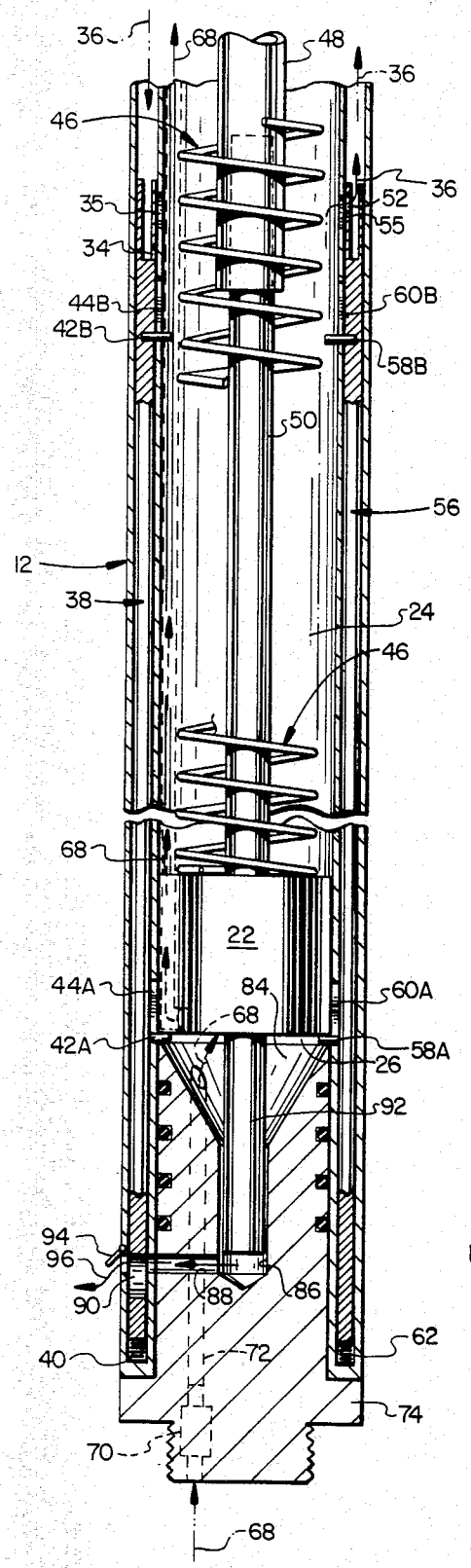
FIG. 2 is a vertical, sectional view which illustrates operation of a sand trap.
Figure 3:
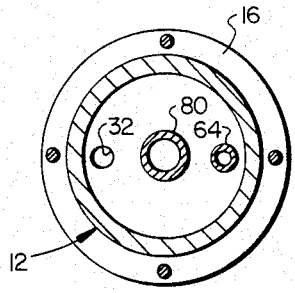
FIG. 3 is a sectional view taken along the lines III—III of FIG. 1A.
Figure 4:
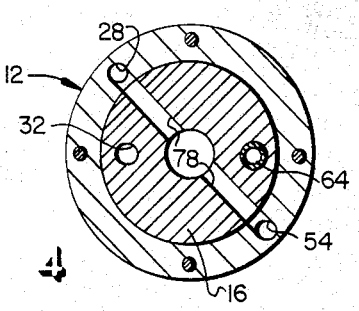
FIG. 4 is a sectional view taken along the lines IV—IV of FIG. 1A.
Figure 5:
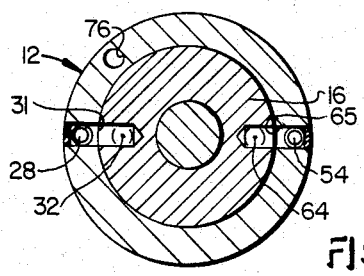
FIG. 5 is a sectional view taken along the lines V—V of FIG. 1A.
Figure 6:
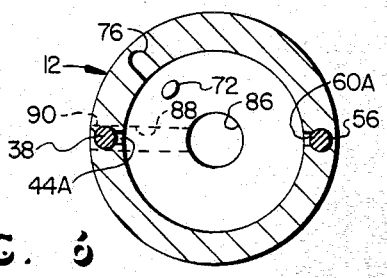
FIG. 6 is a sectional view taken along the lines VI—VI of FIG. 1B.
Figure 7:
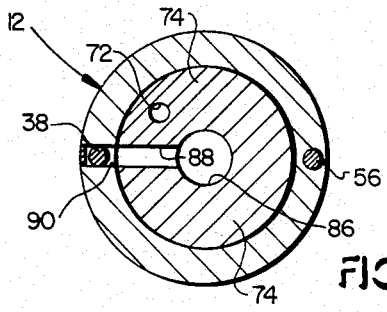
FIG. 7 is a sectional view taken along the lines VII—VII of FIG. 1B; and, FIGS. 8, 9, 10 and 11 are simplified sectional views which illustrate the relative position of the principal pump components during extension and retraction of the piston.
Figures 8, 9, 10, 11:
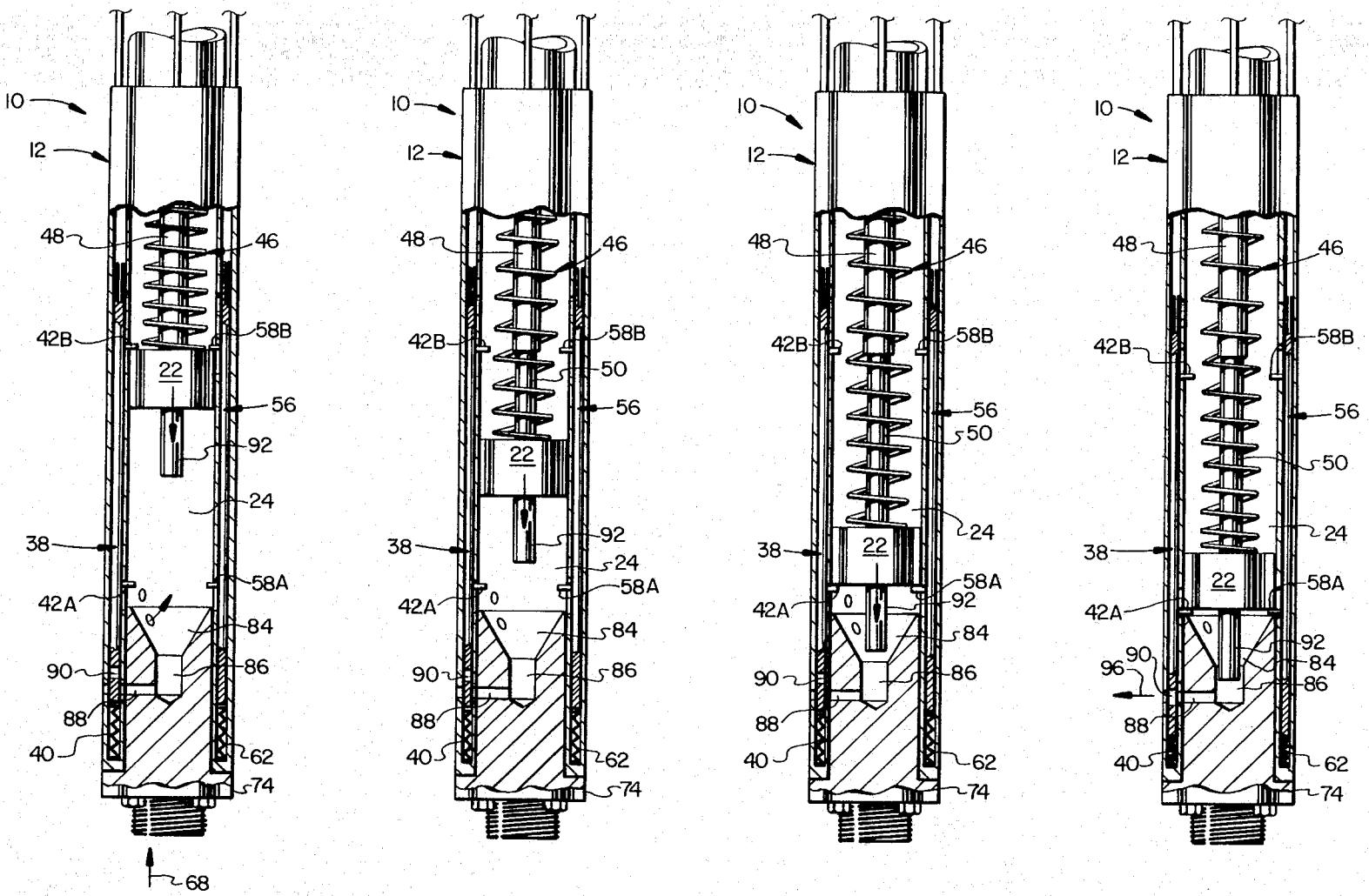

The shuttle rod 38 is biased into the valve open position by a spring 40 which is interposed between the lower end of the shuttle rod 38 and the bottom of the charge bore 28. The shuttle rod 38 is moved from the valve open position, as shown in FIG. 1B, to the valve closed position as shown in FIG. 2 by the engagement of the piston 22 with a first stop member 42A carried by the shuttle rod 38. The first stop member 42A extends through a vertical sidewall slot 44A for engagement with the piston 22 as it nears the end of its production stroke. The lower end of the piston 22 engages the stop member 42A and carries it downwardly, thereby displacing the shuttle rod downwardly and closing the delivery port 34.

The piston is retracted by a spring 46 which has one end coupled to the partition block 16 and the other end anchored to the top side of the piston. The spring 46 encircles a guide tube 48 which is concentrically disposed within the power chamber 24 and which is anchored to the partition block 16. Received in telescoping engagement inside of the guide tube 48 is an extension tube 50 which has its lower end rigidly attached to the piston 22.

The compressed air which is utilized to drive the piston 22 downwardly in a production stroke is also utilized as a brake to limit the rate that the spring returns the piston 22 to its fully retracted position. The high pressure air in the power chamber is discharged through a vent orifice 52 which communicates with a relief bore 54 through a sidewall slot 55. The relief bore 54 extends axially through the pump housing sidewall 12.

The vent orifice 52 is closed and opened by a second shuttle rod 56 which is received in slidable, sealing engagement with the relief bore 54. Attached to the shuttle rod 56 are first and second stop members 58A, 58B which are movable through pump sidewall slots 60A, 60B, respectively. The uppermost stop member 58B is engageable by the top side of the piston 22 as it moves toward its most retracted position, as shown in FIG. 1B. The relief shuttle rod 56 is moved upwardly in the relief bore 54 to close off the relief port 52 so that the power chamber can be repressurized.

As the piston 22 is driven downwardly in its production stroke, the lower side of the piston 22 engages the lower stop member 58A, thereby displacing the shuttle rod 56 downwardly through the relief bore, against the bias force of a spring 62 until the vent orifice 52 is opened.

According to this arrangement, the delivery port 34 is opened and closed, and the vent port 52 is closed and opened by the shuttle rods which are actuated by the piston as it nears the limit of its stroke in extension and retraction, respectively, thereby pressurizing and relieving the power chamber 24 automatically. Thus, the piston 22 is driven downwardly and is retracted automatically without the use of electrical drive motors or hydraulic components.

The rate at which the piston is extended and retracted is dependent upon the effective orifice areas of the delivery port and vent port, and upon the pressure level of the air in the power fluid reservoir. The piston extension rate can be increased from the surface by increasing the pressure of the air in the power fluid reservoir. The rate at which the piston is retracted can be controlled by limiting the rate at which air is discharged out of the power chamber. As can best be seen in FIG. 1A, the relief bore 54 is connected in fluid communication with a vent conduit 64 by a lateral bore 65 which intersects the partition block 16. The vent conduit 64 extends upwardly through the power fluid reservoir 18 through a production conduit 66 to a surface facility (not illustrated) where it is vented to the atmosphere.

The retraction rate of the piston is continuously adjustable by choking the vent conduit at the surface. The high pressure air in the power chamber thus serves as a cushion which limits the retraction rate of the piston. Thus, the stroke rate in both extension and retraction can be precisely controlled from a surface facility to match the supply rate of a natural formation.

Referring now to FIG. 2 and to FIGS. 8, 9, 10 and 11, formation fluid 68 is drawn into the production chamber 26 through a checkk valve 70 which is received within a threaded bore 72. The bore 72 intersects an end block 74 which seals the lower end of the pump chamber. The check valve 70 serves as a produced fluid inlet for admitting formation fluid 68 into the pump chamber during an upstroke, but blocks the flow of formation fluid during the downstroke. Produced formation fluid 68 is forced out of the pump chamber 26 through a large production bore 76 which extends upwardly through the housing sidewall 12 to the partition block 16. The partition block 16 is intersected by a passage 78 which is connected in fluid communication with a production conduit 80. The production conduit 80 extends upwardly through the power fluid reservoir 18 where it is connected in fluid communication with a produced fluid conduit 80 in the production conduit 66. The production conduit 80 is connected in series with a check valve 82 which prevents back flow of the produced formation fluid.

Referring now to FIGS. 1B and 2, the production chamber 26 is enlarged on one end by a funnel-shaped bore 84 and a small blind bore 86 which, in combination, define a sand trap. A lateral bore 88 intersects the end block 74 and communicates with the lower end of the sand trap, thereby providing a discharge path through the pump housing. The sand discharge bore 88 is opened and closed by a slotted portion 38A of the shuttle rod 38. The discharge bore 88 remains closed during retraction and extension of the piston 22 until the piston nears the limit of its stroke in extension. At that point, the piston 22 engages the stop member 42A carried by the shuttle rod 38, and moves the shuttle rod until the slot 90 is in registration with the lateral bore 88. A small cylindrical piston 92 carried by the production piston 22 forces sand and residual formation fluid out of discharge bore as the production piston completes its downward stroke. A small flap 94 is pivotally hinged to the sidewall 12 and opens in response to fluid pressure as the sand and residual formation fluid 96 are discharged. Upon retraction of the piston 22, the shuttle rod 38 is moved upwardly by the spring 40 until the lateral bore 88 is sealed.

It will be appreciated that the pneumatic pump assembly 10 described above is capable of long, relatively slow stroke service. The pneumatically powered piston pump is continuously variable in stroke speed, by adjusting the pressure of the air in the power fluid reservoir and by choking the air vented from the power chamber. The overall assembly is of rugged construction and has a minimum number of moving parts for reliable operation under adverse downhole conditions.

Although a preferred embodiment of the invention has been described in detail, it should be understood that various changes, substitutions and alternations can be made therein without departing from the spirit and scope of the invention as defined by the appended claims.

What is claimed is:

1. A downhole pump for pumping well production fluids and the like from a well, said pump comprising:

an elongated housing adapted to be inserted in a well, said housing defining an elongated cylindrical bore;

a piston reciprocably disposed in said bore and dividing said bore into a power fluid chamber and a production fluid chamber, said piston being movable through an extension stroke and a retraction stroke with respect to said production fluid chamber to discharge and intake fluid with respect to said production fluid chamber, respectively;

means forming an inlet port opening into said production fluid chamber for admitting fluid to said production fluid chamber, and means forming a discharge port for conducting fluid out of said production fluid chamber;

first valve means for introducing power fluid into said power fluid chamber for causing said piston to move through said production fluid chamber on an extension stroke to deliver a charge of fluid through said discharge port;

second valve means for venting power fluid from said power fluid chamber;

means operable to be actuated by said piston at a predetermined point on said extension stroke to cause said first valve means to close off communication of power fluid to said power fluid chamber, and to cause said second valve means to vent power fluid from said power fluid chamber;

an end block of said housing including a sand trap chamber formed therein;

third valve means for venting said sand trap chamber, said third valve means being actuated by means during an extension stroke of said piston to vent fluid from said sand trap chamber; and, said piston including a piston part operable to extend into said sand trap chamber during an extension stroke of said piston to substantially isolate said sand trap chamber from said production fluid chamber and to displace fluid in said sand trap chamber through said third valve means.

2. The pump set forth in claim 1 wherein:

said means actuated by said piston on said extension stroke includes a shuttle member for actuating said first valve means and said third valve means, respectively.

3. The pump set forth in claim 2 wherein:

said shuttle member comprises an elongated rod disposed in a bore formed in said housing and including port means cooperable with port means opening into said bore for said shuttle member for valving fluid from said sand trap chamber.

4. The pump set forth in claim 2 including:

spring means for biasing said shuttle member to close said first and third valve means, respectively.

* * * * *